US006745959B2

(12) United States Patent
Reid

(10) Patent No.: US 6,745,959 B2
(45) Date of Patent: Jun. 8, 2004

(54) IRRIGATOR

(76) Inventor: Stuart Dundonald Reid, 266 Normandale Road, Lower Hutt (NZ)

( * ) Notice: Subject to any disclaimer, the term of this patent is extended or adjusted under 35 U.S.C. 154(b) by 68 days.

(21) Appl. No.: 09/874,714

(22) Filed: Jun. 5, 2001

(65) Prior Publication Data

US 2002/0030128 A1 Mar. 14, 2002

(30) Foreign Application Priority Data

Jun. 6, 2000 (NZ) ..... 504997
Nov. 10, 2000 (NZ) ..... 508128

(51) Int. Cl.[7] ..... B05B 3/00

(52) U.S. Cl. ..... 239/747; 239/255; 239/264; 239/722; 239/745

(58) Field of Search ..... 239/225.1, 242, 239/159, 160, 264, 265, 722, 723, 743, 744, 745, 747, 230, 251, 255

(56) References Cited

U.S. PATENT DOCUMENTS 494,847 A * 4/1893 Creed ..... 239/255
754,172 A * 3/1904 Sutherland ..... 239/255
2,087,175 A * 7/1937 Voight ..... 239/255
3,047,236 A * 7/1962 Fahrner ..... 239/264
3,583,636 A * 6/1971 Lacey ..... 239/745
3,684,178 A * 8/1972 Friedlander ..... 239/745
4,003,519 A * 1/1977 Kruse et al. ..... 239/745
4,434,937 A * 3/1984 Pitchford ..... 239/230
5,390,858 A * 2/1995 Watson ..... 239/744

* cited by examiner

*Primary Examiner*—Steven J. Ganey
(74) *Attorney, Agent, or Firm*—Volpe and Koenig, P.C.

(57) ABSTRACT

An irrigator has a single irrigation arm adapted to move in reciprocal rotational motion. In a first setting, the irrigator sprays irrigating liquid at a first orientation with respect to the arm to move the arm in a first direction. In a second setting, the irrigator sprays irrigating liquid at a second orientation with respect to the arm to effect a reversal in the rotational direction of the arm. Alternating mechanisms are provided to alter the arm between the first and second settings.

14 Claims, 9 Drawing Sheets

IRRIGATOR

FIELD OF INVENTION

This invention relates to irrigators, and in particular it relates to travelling irrigators having only one irrigation arm moving in oscillating reciprocal motion. The irrigators of the invention are particularly suitable as travelling irrigators of the kind that are mounted on wheels and drawn by means of a fixed cable over a field or paddock.

BACKGROUND

A large variety of irrigators, and particularly travelling irrigators are known. The traditional travelling irrigator, generally used to supply effluent from dairy milking sheds to nearby pasture or crop land, has two arms which are rotated by the forces generated by the discharge jet of irrigating liquid in each arm. The rotating arms are usually linked to a winch which winds up a cable attached to a distant, fixed post. The tension in the cable created as it is wound in by the winch, causes the irrigator to be pulled along the paddock being irrigated, and the liquid supply hose, being attached to the irrigator, is pulled along the paddock. As the two arms of the irrigator rotate constantly in one directly they therefore need to be connected to the supply hose by means of a mechanism which enables the rotation without winding up or twisting the supply hose. Traditionally a rotary gland is provided for this purpose, which contains of necessity, seals and rubbing parts which are immersed in the irrigating liquid. It is desirable to use milking shed effluent or the like as the source of irrigating liquid and this liquid usually contains a high percentage of sand and grit which subjects the glands to high wear and tear. It is therefore desirable to be able to provide an irrigator which can dispense with the need for a gland or the like.

Furthermore, in the traditional two-arm irrigators two nozzles are operating simultaneously. If all the liquid being pumped through the two nozzles was directed through a single nozzle it would have almost double the range or carry for the same pumping effort and therefore be distributed over nearly twice the area. Furthermore a single larger nozzle would be less likely to become clogged with grit, sand or other particulate matter in the irrigating liquid.

A further potential advantage of an irrigator employing only one arm and one nozzle is in the regularity with which it must be shifted. The two arm irrigators need to be shifted every seven to ten days. However, a single arm irrigator, with the ability to distribute liquid over approximately twice the area, would only need to be shifted every fourteen to twenty days. As there is a large amount of effort involved in shifting these irrigators this represents a considerable advantage to the farmer.

There is therefore an advantage in providing an irrigating apparatus which can extend the area over which liquid can be distributed and eliminate the need for complex moving parts within the apparatus.

OBJECT

It is an object of the invention to provide an improved apparatus for the irrigation of large areas of farmland and the like, or at least to provide the public with a useful choice.

It is another object of the invention to provide an improved method for the irrigation of large areas of farmland and the like or at least to provide the public with a useful choice.

STATEMENT OF INVENTION

In one aspect the invention provides an irrigator including a single irrigation arm said arm adapted to move in reciprocal rotational motion by in a first setting spraying irrigating liquid at a first orientation with respect to the arm to move the arm in a first direction and in a second setting spraying irrigating liquid at a second orientation with respect to the arm to effect a reversal in the rotational direction of the arm, and including means to alter the arm from said first to second settings.

Preferably the irrigation arm has at least one nozzle set at a fixed angle with respect to the arm so that in a first setting of the arm the emerging irrigation liquid causes the arm to rotate in a first direction, and means to effect a rotation of the arm through substantially 90° about its longitudinal axis at the end of each rotational arc to a second setting in which the emerging irrigation liquid causes the arm to rotate in the reverse direction.

Preferably a rocker arm is attached to the irrigation arm and in a first position is in contact with a first actuator which is adapted to be activated at the end of a first rotational arc of the irrigation arm in a first direction and on activation causes the rocker arm to rotate through substantially 90° to a second position in contact with a second actuator and simultaneously effecting a rotation of the irrigation arm through substantially 90° about its longitudinal axis to thus cause the arm to move in a second or reverse direction, said second actuator being similarly adapted to be activated at the end of the rotational arc of the irrigation arm in the second direction.

Optionally the irrigator arm is fitted with at least one nozzle, adapted to move from a first to a second position with respect to the arm at the end of each rotational arc of the arm.

Preferably the the inner end of the irrigation arm is connected to a flexible hose through which the irrigating liquid is delivered.

Preferably the irrigator arm rotates through about 180° before the rotational direction is reversed.

Preferably the irrigator is fitted with wheels and the reciprocating motion of the irrigation arm is converted to a unidirectional motion for the purpose of activating driving means to wind in a cable attached at a first end to the winding means located on the irrigator and at a second end to a fixed point outside the irrigator such that as the cable is wound in by the motion of the irrigator arm the irrigator is moved over the terrain to be irrigated.

Preferably the winding means includes a drive shaft upon which a capstan drum including at least one self-tailing sheave and at least one active sheave is fixedly mounted and an idler shaft on which at least one idler sheave is rotatably mounted is in combination with a cable guide fixedly mounted to a rotating guide shaft positioned substantially centrally with respect to a cable container so that as the cable leaves the self-tailing sheave of the winding apparatus it passes through the cable guide and as the guide shaft rotates the cable is laid into the cable container.

Optionally the winding mechanism is a winch in combination with a cable reel.

In another aspect the invention provides an apparatus for irrigation including a single irrigation arm attached at its inner end to a hose means providing the irrigating liquid to the said arm and adapted to enable repeated oscillating rotational motion of the arm, and provided at its outer end with nozzle means positioned to direct the stream of emerging irrigating liquid at a first angle with respect to said arm such that the force of the emerging liquid causes the arm to rotate in a first direction, and at the end point of the said first rotation to effect a reversal in the rotational direction of the said arm by altering the position of the nozzle relative to the arm to direct the stream of the emerging liquid at a second angle with respect to the said arm, and repeating said reversal at the end of each rotational swing of the arm.

Preferably the hose means consists of at least a segment of the hose being formed from a hosing material so constructed as to have a greatly reduced tortional resistance.

Alternatively the hose means consists of one or more coils of hose which can repeatedly tighten or loosen as the arm oscillates between the first and reverse directions.

Preferably the arm is counterbalanced. When the irrigator moves over an inclined surface the solitary arm is subject to gravitational force and would tend to rotate to a neutral position. Preferably therefore the arm would be fitted with a counterbalance to prevent this from happening. The counterbalance could be formed from a hollow tube which fills with liquid when the irrigator begins to operate, and which exactly counterbalances the single arm when full. However, any suitable method of counterbalancing the arm is envisaged as being within the scope of the invention.

In another aspect the invention provides a method of irrigating comprising connecting an irrigator including a single irrigation arm said arm adapted to move in reciprocal rotational motion by in a first setting spraying irrigating liquid at a first orientation with respect to the arm to move the arm in a first direction and in a second setting spraying irrigating liquid at a second orientation with respect to the arm to effect a reversal in the rotational direction of the arm, and including means to alter the arm from said first to second settings, to a source of irrigation liquid at a sufficient pressure to activate the irrigation arm, and causing the liquid to flow through the irrigation arm.

In yet another aspect the invention provides a method of irrigation comprising the steps of connecting an apparatus including a single irrigation arm attached at its inner end to hose means providing the irrigating liquid to the said arm and adapted to enable repeated oscillating rotational motion of the arm, and provided at its outer end with nozzle means positioned to direct the stream of emerging irrigating liquid at a first angle with respect to said arm such that the force of the emerging liquid causes the arm to rotate in a first direction and at the end point of the said first rotation to effect a reversal in the rotational direction of the said arm by altering the position of the nozzle relative to the arm to direct the stream of the emerging liquid at a second angle with respect to the said arm, and repeating said reversal at the end of each rotational swing by the arm, to a source of a liquid for irrigation, and spraying said liquid over the areas to be irrigated.

Preferably the irrigating liquid is the effluent liquid from a cow milking shed or the like.

Alternatively the irrigating liquid is water.

The invention will now be described in detail by way of some preferred embodiments. However, it will be appreciated that variations, modifications and additions may be made on these embodiments without departing from the scope of the invention.

The preferred embodiments refer to the accompanying drawings in which.

EXAMPLE ONE

Figure 1:
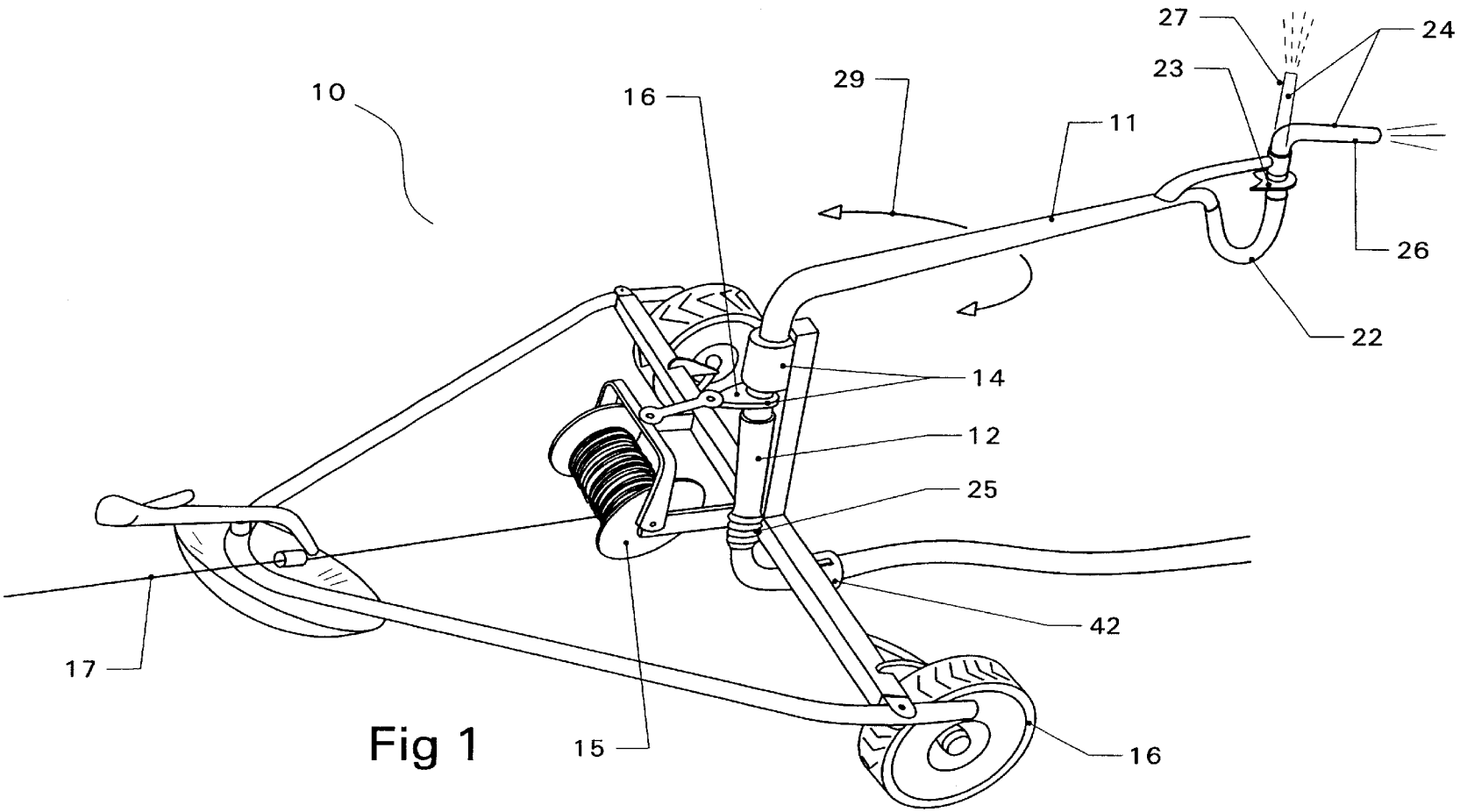
FIG. 1 is a perspective view of a first embodiment of an irrigator according to the invention.
Figure 2:
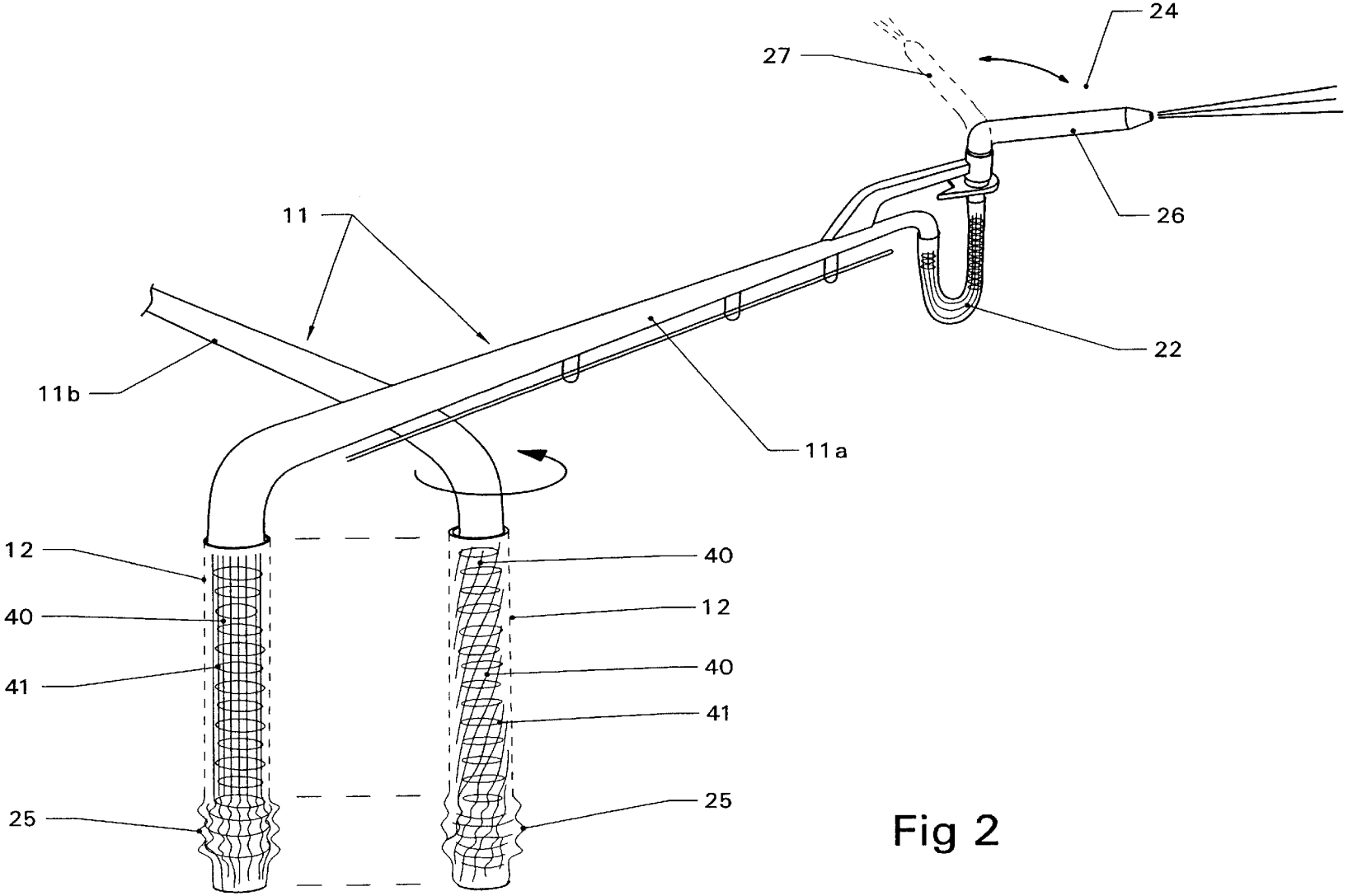
FIG. 2 is a perspective view of the irrigator arm of the irrigator of FIG. 1 provided with a nozzle with nozzle position switching means.

Referring to FIGS. 1 and 2 a travelling irrigator 10, is shown in which a single irrigator arm 11 is connected by way of a segment of hosing 12, which has a very low tortional resistance, to a supply line 13, providing irrigating liquid. The segment of flexible hosing 12 includes a folded or concertina'd portion 25, which enables the length of the segment to extend or retract as required while the irrigator arm 11 moves through its swing arc.

The arm is connected by way of a mechanism 14 which enables the winch 15 to be turned on activation of the irrigator arm 11. The whole apparatus is mounted on wheels 16, so that as the cable 17 is drawn in by the winch the apparatus moves towards a distant fixed point to which the cable is attached.

The arm 11 ends in a second segment of flexible hosing 22, and a nozzle directional switching mechanism 23 to which a nozzle 24 is fixed, When the irrigator arm is at the end of the oscillation in the direction as defined by the arrow 28 the nozzle is in the position 26. In this position the force of the stream of liquid exiting the nozzle moves the irrigator arm 11, in the direction of arrow 29 until it reaches the end of this oscillation, after travelling through an angle of about 180°. At this point the nozzle directional switching mechanism 23 activates to flick the nozzle into its second position 27. Now the force of the stream of liquid exiting the nozzle has the effect of reversing the direction of the irrigator arm and moving it in the counter direction shown by arrow 28. At the end of the arc of movement in this direction the nozzle directional switching mechanism 23 again activates to return the nozzle to position 26 and reverse the direction of movement of the arm to that of arrow 29, and so the cycle is continuously repeated. As the arm moves in the oscillating rotational motion described the mechanism 14 connecting the arm to the winch causes the winch 15 to rotate to draw in the cable 17 and so draw the irrigator in the direction of arrow 30.

Some details of the manner in which the irrigator arm is facilitated in its oscillating rotational motion are shown in FIG. 2 where the irrigator arm 11 is shown in its two positions 11*a* and 11*b*. The flexible segment of hose 12 has a very low tortional resistance as a result of the manner in which the hosing material is constructed.

Traditionally hosing is formed from a webbing or braiding where the braid or web is laid up at about 45° to the centre hose axis. This ensures that the hosing is very resistant to torsion and consequently does not twist freely. The hosing used in segments 12 and 22 however is formed from reinforcing braid laid down so that it is both parallel 40, and perpendicular 41, to the centre hose axis, as shown when the arm 11 is in position 11*a*. When the arm moves to position 11*b* the hose 12 is able to twist to accommodate the movement as the perpendicular web or braid 41 moves concurrently. The convolutions or folds 25 allow the hose to lengthen if necessary, as it is twisted. This ensures that the hose does not work itself off the connection 42 to the supply line 13.

EXAMPLE TWO

This preferred irrigator 30, as illustrated in FIGS. 3 to 7 is essentially the same as that of Example One, except that the irrigator arm 11 and the nozzle 32 are formed as a single unit with the nozzle fixed in the preferred orientation with respect to the arm and with a means for altering the direction of the nozzle at the outer end of each rotation of the arm being located on the 11, and its associated support 80. The said means operate to turn the entire irrigator arm 11, through an angle of substantially 90° about its longtitudinal axis, thus reversing the direction of the fixed nozzle and hence the direction of rotational movement of the arm. In this example the arm 11, is supported on the frame 80, by means of rocker hinges 81 and 81*a*, and held fixed in position by pin 82. A rocker arm 83, is fitted with a spring actuator bar 83*a*, such that, at the outer ends of the rotation of the irrigator arm the spring actuator bar 83*a* is abutted on and bending against either of two rocker arm actuators, 84, and 84*a*. The frame 80 is hollow and a rod 85 is inserted through its interior to connect at its outer end with the pin 82, and at its inner end to a pivot point 86. The pin 82, is fitted inside a bush 87, and is structured to include an interior cavity 88 into which the rod 85 is inserted. At this outer end the rod 85, is fitted with a stop 89. In operation, the pin 82 holds the rocker arm 83 in position, so that it cannot be moved while the irrigator arm is in the middle of its rotational cycle. The pivot point 86, of the rod 85, is offset from the point 86*a*, about which the irrigator arm itself rotates, so that as the irrigator arm 11, moves through its rotational cycle, the rod 85 retracts within the frame 80 as the irrigator arm moves towards the outer end-points of its rotation, and extends towards the outer end of the frame as the irrigator arm approaches the central point of the rotation. Consequently the rotational cycle of the irrigator arm has the effect of withdrawing the pin 82 completely into the frame 80 at the end point of the rotation as a result of the stop 89 pulling back on the interior cavity of the pin as the arm 85 retracts with respect to the frame. At the point defining the outer end of the rotational cycle of the irrigator arm 11, the pin 82, is completely withdrawn into the frame 80, and the spring actuating bar 83*a* is bending against the rocker arm actuator 84 or 84*a*, thus effecting the moving or flipping of the rocker arm 83 through an angle of about 90°. The rocker arm is prevented from flipping through a substantially greater angle than 90° by means of a stop 90, fitted on the irrigator arm such that it contacts the frame 80 once the rocker arm has flipped through about 90°. Consequently the entire irrigator arm is rotated through an angle of about 90° around its longtitudinal axis. The irrigator arm is initially held in this second position for the return rotational cycle of the arm by its own weight, and a spring if necessary. The pin 82, immediately begins to re-emerge from the frame 80, on the reversed direction of rotation of the irrigator arm 11, and thereafter ensures that a flipping of the arm to the alternate position cannot take place. And so the cycle repeats. The mechanism by which the pin 82 re-emerges from the frame 80, as rod 85 is now moved outwards relative to it, involves the spring 91 and the collar 92. As the rod moves towards the outer end of the frame, the collar 92 pushes on the spring 91, which in turn eases the pin 82 through its exit hole in the frame 80. If for any reason, the rocker arm 83 has not flipped completely into its second position, and is partially or fully blocking the exit hole for the pin, the emerging rod 85 is protected from buckling once the resistance of the pin against the rocker arm 83, is encountered as it merely continues to move within the interior cavity 88, of the pin, and is not subject to any resistant force. The length of the rod 85, relative to the length of the interior cavity 88 is such that the rod can never contact the rocker arm 83, itself.

Figure 9:
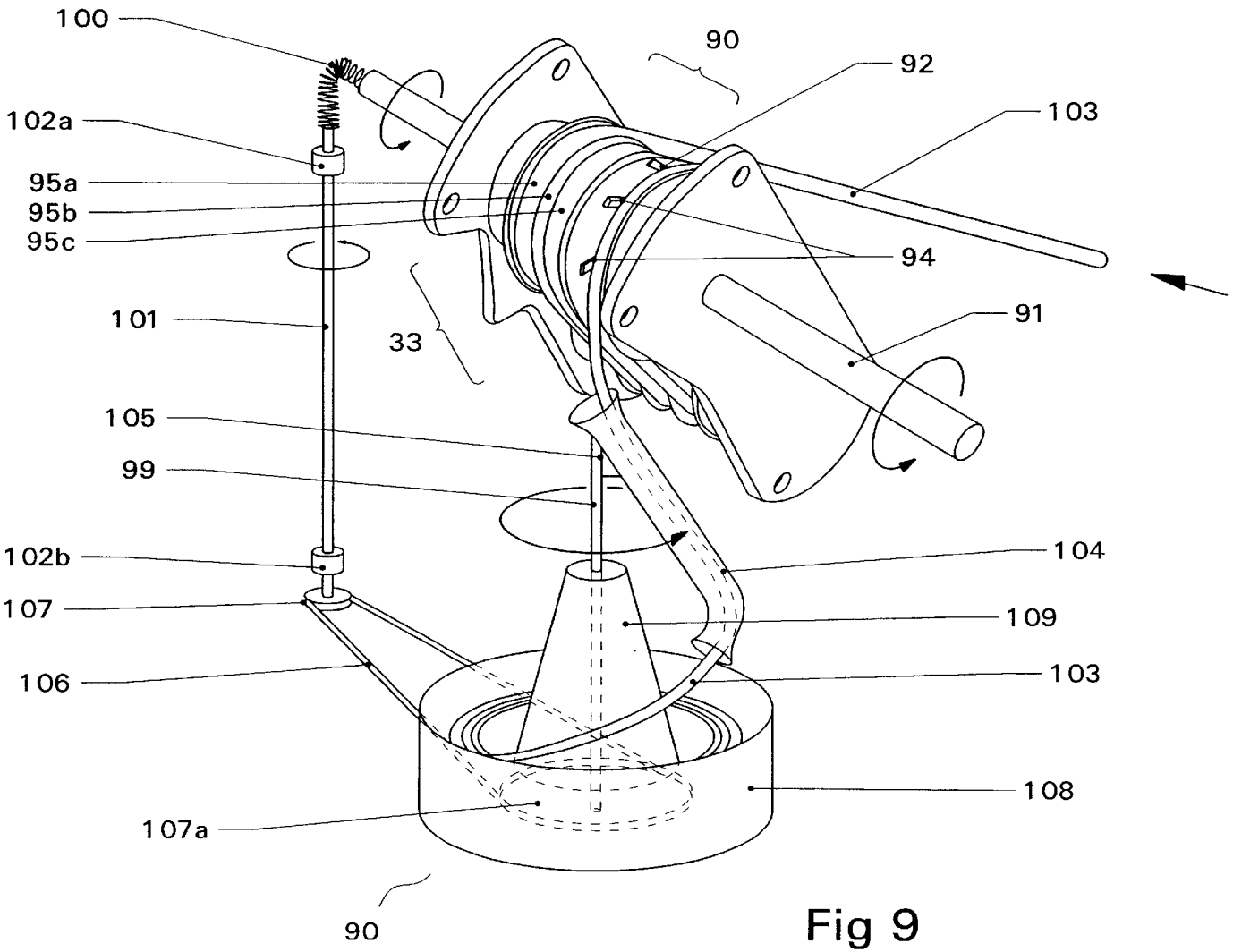
FIG. 9 is a perspective view of the preferred winding apparatus.

This preferred embodiment also incorporates the winding apparatus shown in detail in FIG. 9, in which a combination of a winding unit 33 with a cable guide 104 and cable container 108 is detailed. A capstan drum 90, is mounted on the drive shaft 91. The capstan drum comprises one self-tailing sheave 92 which has a wedge shaped groove in which self-tailing jaws 94, are formed. The remainder of the capstan drum is formed from three active sheaves 95*a*, 95*b*, and 95*c*. The self-tailing and active sheaves forming the capstan drum are all fixedly mounted to the drive shaft 91, and rotate as a unit with the drive shaft. The preferred wedge-shape of the groove of the self-tailing sheave allows the cable to sink deeper into the groove when it is under tension, thus improving the grip of the sheave on the cable because of the wedging action. Preferably gripping teeth 94, are disposed about the face of the wedged groove to enhance the grip between the cable and the groove. The grooves of the active sheaves are also preferably of a wedge shape to enable the cable to become wedged into the groove of each sheave, In addition the surface of the grooves can be textured or roughened to increase the friction between the cable and the sheave, and the diameter at the bottom of the groove is slightly less than the diameter of the cable.

The motion of the irrigator arm is converted to a unidirectional motion to turn the driving shaft 91 and also drives the guide shaft 99, by means of the linkages 100, 101, 107, 106 and 107*a*. The direction of turn of the drive shaft shown is the direction when the capstan is winding the cable in. A flexible coupling spring 100, connects the drive shaft 91 to a lay shaft 101, mounted by way of lay shaft bearings 102*a* and 102*b*. The cable 103, is wound as previously described, and from the self-tailing sheave 92 is fed into the cable guide 94. The cable guide 94, is fixed to the guide shaft 99 by any suitable fixing means 105. The lay shaft 101, is connected to the guide shaft 99, by means of a V-belt 106, and pulleys 107 and 107*a*. However, it is also envisaged in the preferred option that the pulleys may be replaced by sprockets. The rate at which the cable is coiled into the cable container 108 can be varied by varying the size of the pulleys, sprockets or the like. As the guide shaft 99 rotates the cable guide 104 revolves over the open cable container 108, and when the cable is being wound in and thus it is layered without tangles into the container 108. The preferred cable container has a conical inner core 109. This internal cone assists the feeding out of the cable if the rotational speed of the cable guide does not quite match the speed at which the cable is paid out.

Figure 3:
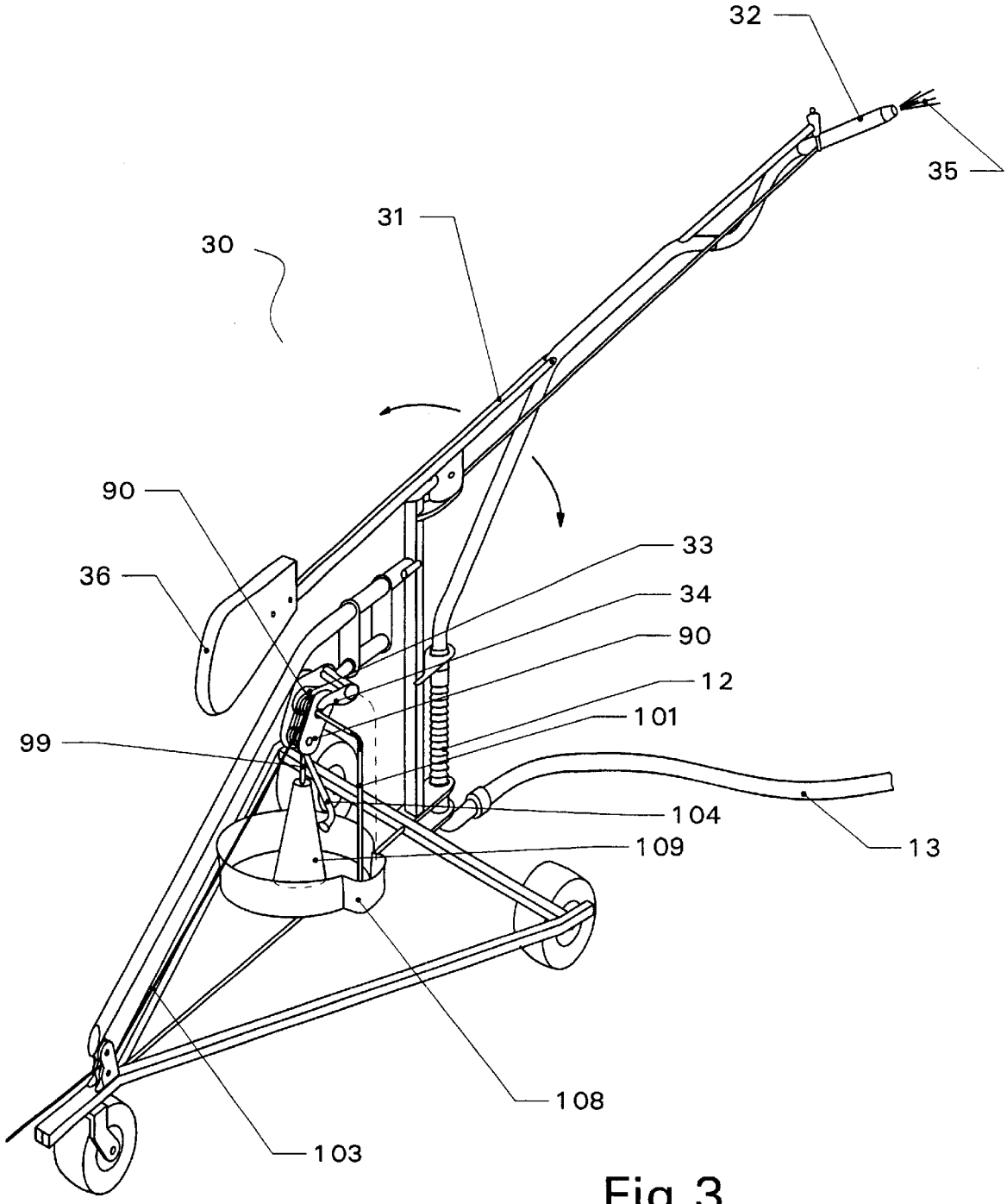
FIG. 3 is a perpective view of a second embodiment of an irrigator according to the invention.
Figure 4:
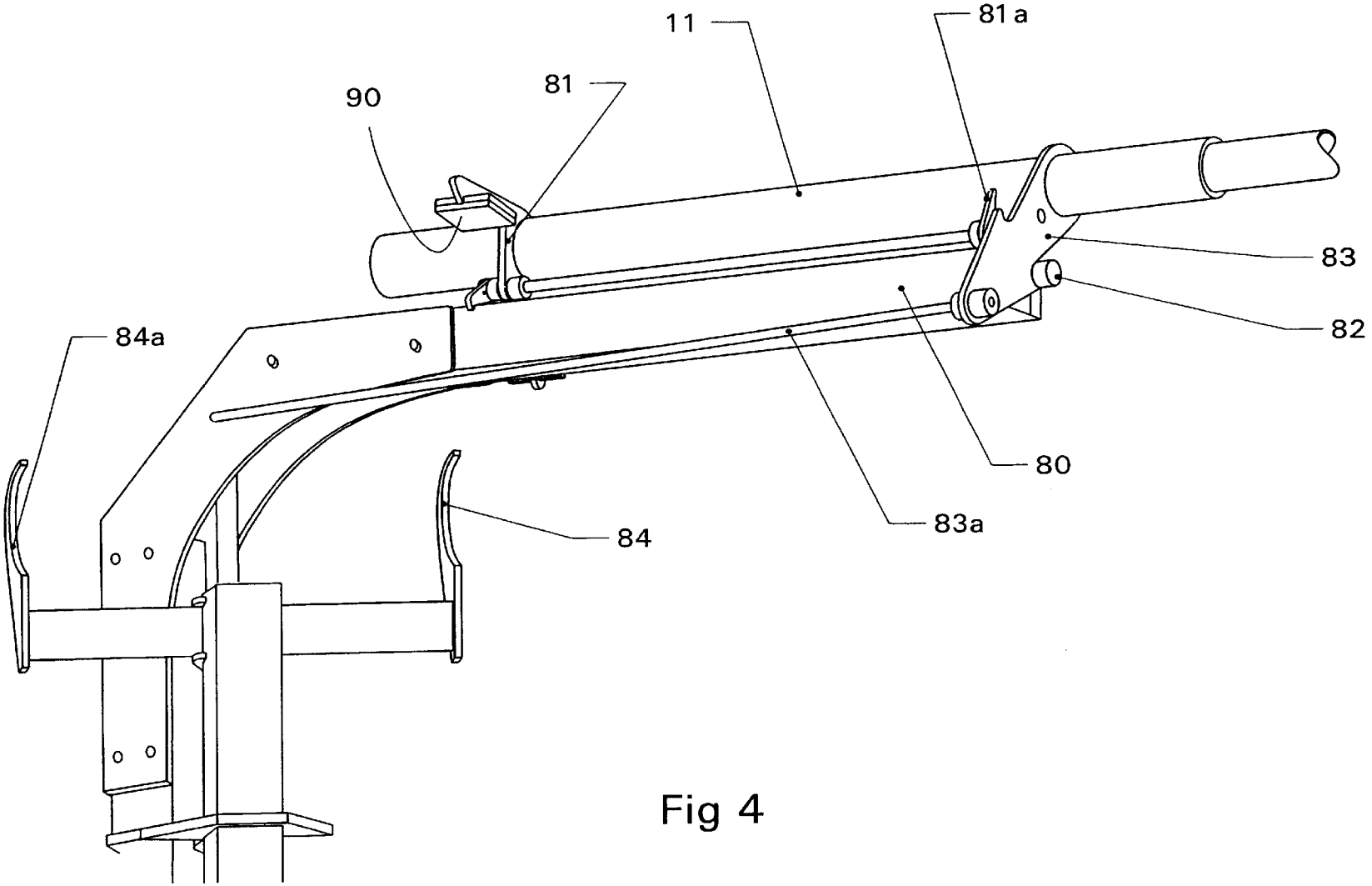
FIGS. 4 and 4A are perspective views of the irrigator arm of FIG. 3 in which the nozzle is contiguous with the arm, fitted with a preferred means for effecting rotation of the arm about its longtitudinal axis.
Figure 4A:
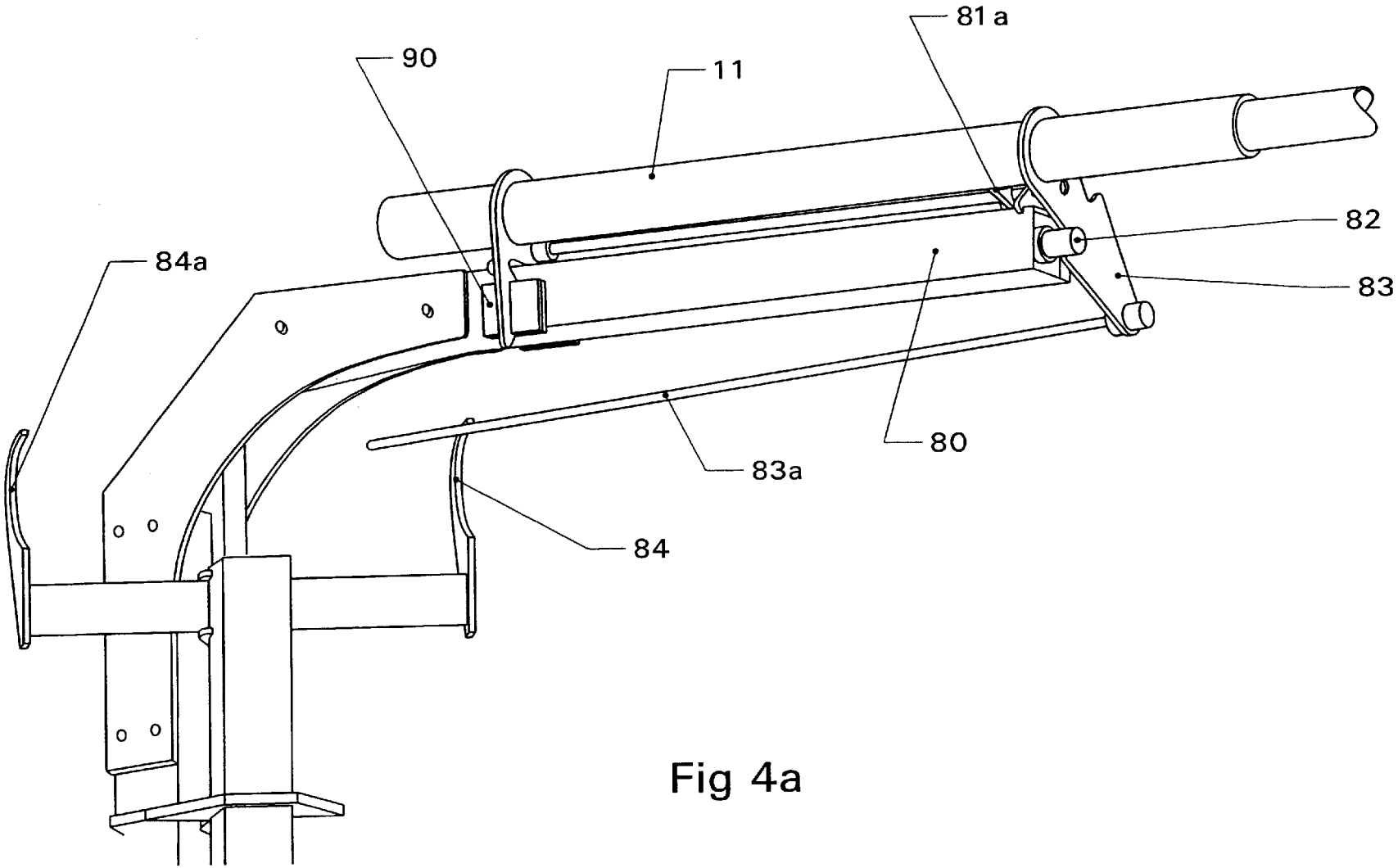
Figure 5:
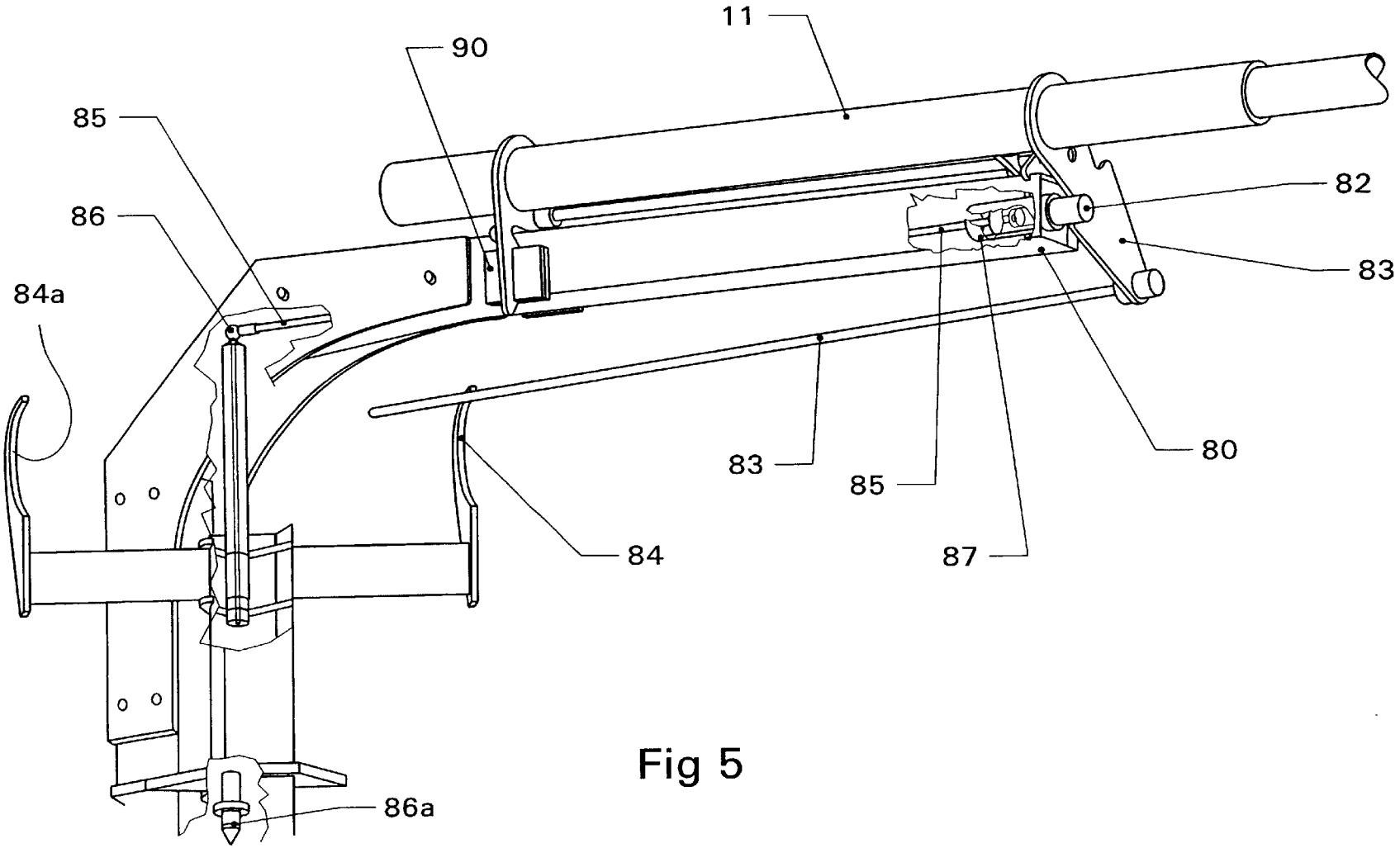
FIG. 5 is the irrigator arm of FIG. 4A with the interior mechanism revealed.
Figure 6:
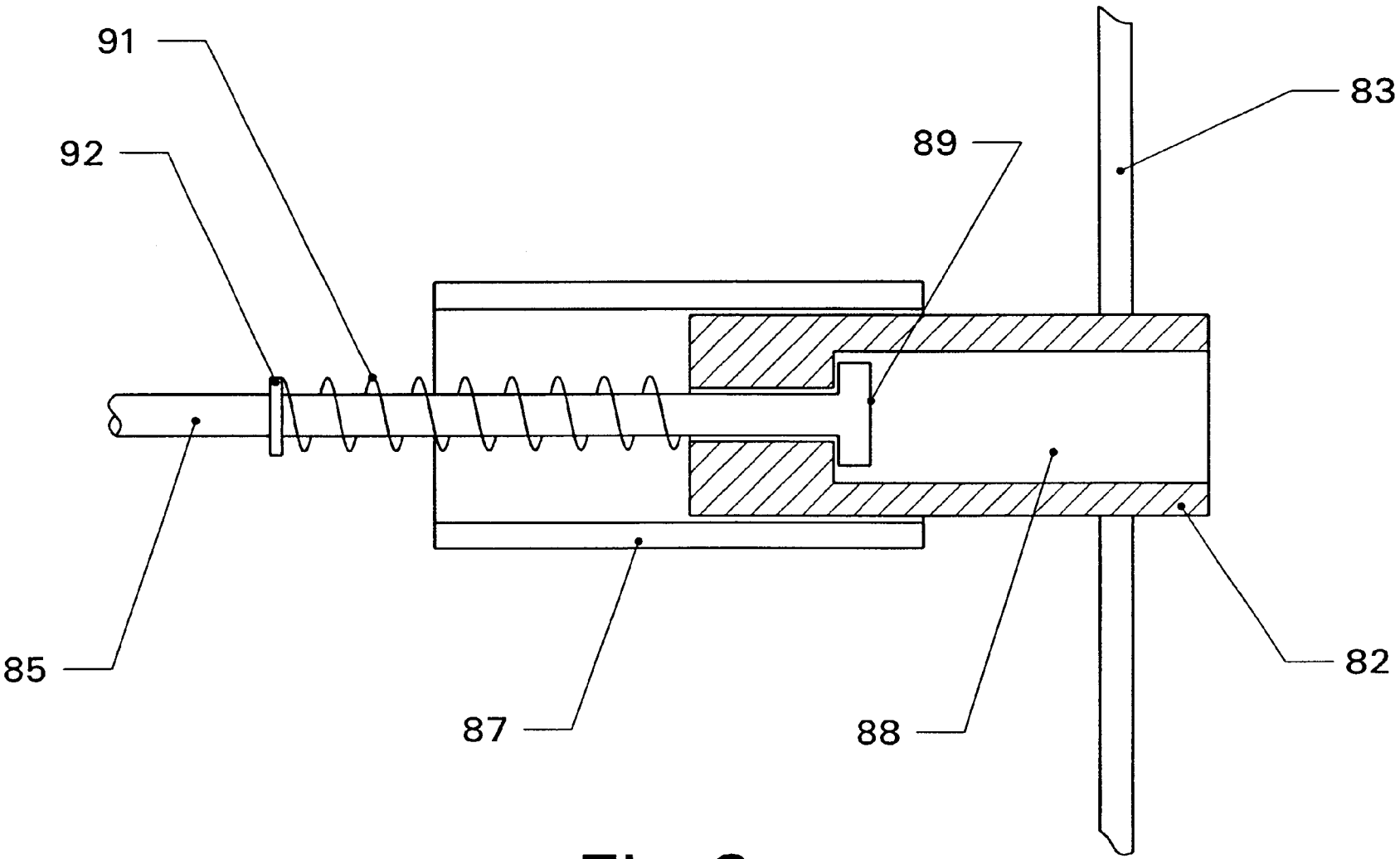
FIG. 6 is a cross-sectional view of the pin of the the mechanism of FIG. 5.

Turning to FIG. 3, the irrigator 30 has a single irrigation arm 31, the reciprocal rotational motion of which is converted to unidirectional motion to turn the drive shaft upon which the capstan drum 90, is fixedly mounted, and thus by way of linkages, the lay and guide shafts 101 and 99 as well. The combination of the winding apparatus and the cable container are mounted on the irrigator 30, by way of a gimbal 34. The cable 103, is tethered to a fixed point outside the irrigator, and as the irrigator arm 31, rotates it drives the winding apparatus to wind in the cable 103, and layer it into the cable container 108, thus drawing the irrigator towards the fixed point, and enabling a given area of terrain to be irrigated. The irrigator arm 31, is driven by the ejected jet of irrigating liquid 35 being forced through the nozzle 34, of the irrigator arm.

The irrigator is further fitted with a counterbalance 36.

Figure 7:
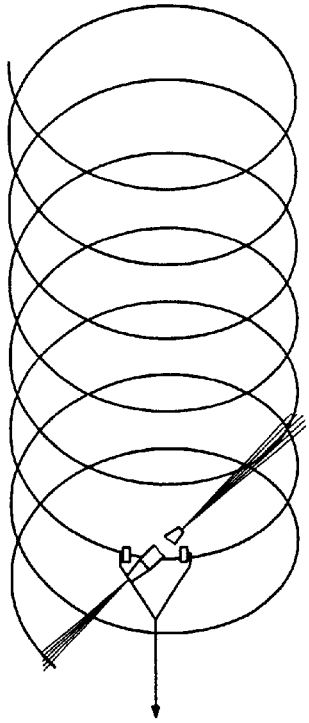
FIG. 7 illustrates the distribution path of liquid sprayed from the known two arm irrigators.
Figure 8:
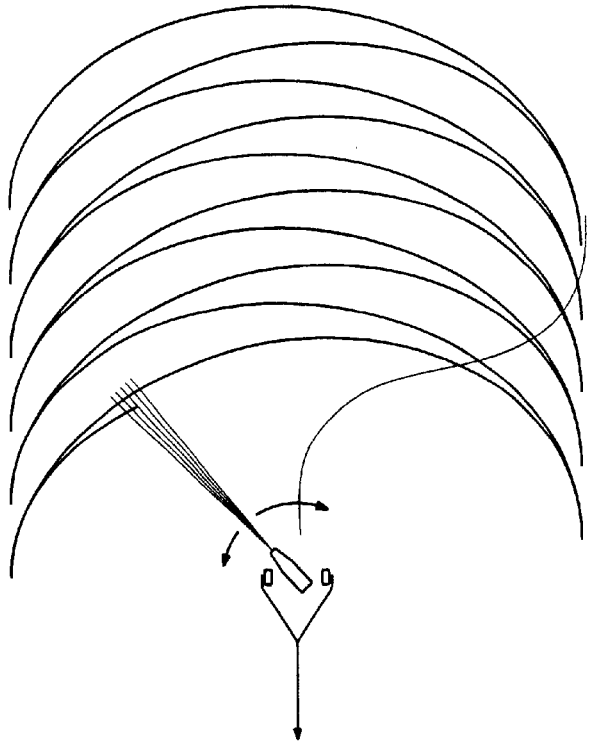
FIG. 8 illustrates the distribution path of liquid sprayed from the irrigator of the invention.

In all of the preferred embodiments described above the irrigation arm is set to oscillate through an arc of about 180° and the dispersion of the irrigation liquid follows a trace as shown in FIG. 8. The trace showing the dispersion of irrigation liquid through the two rotating arms of the previously known irrigators is shown in FIG. 7, In the irrigator of the present invention the entire supply of the liquid is forced through one nozzle instead of two and consequently the jet range is almost doubled, A comparison of the traces in FIGS. 7 and 8 shows that the distribution area for the apparatus of the invention is nearly twice that of previous irrigators.

Throughout description of this specification the word "comprise" and variations of the word such as "comprises" and "comprising" are not intended to exclude otther additives, components, integers or steps.

Finally, it will be appreciated that various aspects of the present invention have been discussed by way of example only, and modifications and additions may be made thereto without departing from the scope of the invention.

What is claimed is:

1. A traveling irrigator including a single irrigation arm, wherein said arm is adapted to move in reciprocating motion by, in a first setting, spraying irrigating liquid at a first orientation angled with respect to a longitudinal axis of the arm whereby the force of the irrigating fluid emerging from the arm causes the arm to move in a first direction and, in a second setting, spraying irrigating liquid at a second orientation with respect to the longitudinal axis of the arm to effect a reversal in the rotational direction of the arm, and including means to alter the arm from said first to second settings, wherein the irrigator is fitted with wheels and the reciprocating motion of the irrigation arm is converted to a unidirectional motion for the purpose of activating driving means to wind in a cable attached at a first end to a winding means located on the irrigator and at a second end to a fixed point outside the irrigator such that as the cable is wound in the irrigator is moved over the terrain to be irrigated.

2. A traveling irrigator as claimed in claim 1, wherein the irrigation arm has at least one nozzle set at a fixed angle with respect to the arm so that in said first setting of the arm the emerging irrigation liquid causes the arm to rotate in said first direction, and said altering means effects a rotation of the arm through substantially ninety (90°) degrees about its longitudinal axis at the end of each rotational arc to said second setting in which the emerging irrigation liquid causes the arm to rotate in the reverse direction.

3. A traveling irrigator as claimed in claim 2 wherein the irrigation arm has a single nozzle formed continually at the outer end of the arm and at a fixed angle to the arm.

4. A traveling irrigator as claimed in claim 2 wherein a rocker arm is attached to the irrigation arm and in a first position is in contact with a first actuator which is adapted to be activated at the end of a first rotational arc of the irrigation arm in a first direction and on activation causes the rocker arm to rotate through substantially ninety (90°) degrees to a second position in contact with a second actuator and simultaneously effecting a rotation of the irrigation arm through substantially ninety (90°) degrees about its longitudinal axis to thus cause the arm to move in said reverse direction, said second actuator being similarly adapted to be activated at the end of the rotational arc of the irrigation arm in the reverse direction.

5. A traveling irrigator as claimed in claim 4 wherein the rocker arm is held in each of its first and second positions by a movable pin so mounted on the irrigator that the pin is withdrawn from its holding position at the end of each rotational arm of the irrigation arm and re-emerges into its holding position when the irrigator arm begins to move in the changed direction.

6. A traveling irrigator as claimed in claim 1 wherein an inner end of the irrigation arm is connected to a flexible hose through which the irrigating liquid is delivered.

7. A traveling irrigator as claimed in claim 1 wherein the irrigator arm rotates through about one hundred eighty (180°) degrees about said longitudinal axis before the rotational direction is reversed.

8. A traveling irrigator as claimed in claim 1 wherein the winding means includes a winch and a cable reel.

9. A traveling irrigator as claimed in claim 1 including a counterbalance for the irrigation arm.

10. A method of irrigating comprising connecting a traveling irrigator as claimed in claim 1 to a source of irrigating liquid, and causing the irrigating liquid to flow through the irrigation arm with sufficient pressure to cause the irrigator arm to move.

11. A method of irrigating according to claim 10 wherein the irrigating liquid is liquid effluent from a cow milking shed or the like.

12. A method of irrigating as claimed in claim 10 wherein the irrigating liquid is water.

13. An irrigator including a single irrigation arm, wherein said arm is adapted to move in reciprocating motion by, in a first setting, spraying irrigating liquid at a first orientation angled with respect to a longitudinal axis of the arm whereby the force of the irrigating fluid emerging from the arm causes the arm to move in a first direction and, in a second setting, spraying irrigating liquid at a second orientation with respect to the longitudinal axis of the arm to effect a reversal in the rotational direction of the arm, and including means to alter the arm from said first to second settings, the irrigator is fitted with wheels and the reciprocating motion of the irrigation arm is converted to a unidirectional motion for the purpose of activating driving means to wind in a cable attached at a first end to a winding means located on the irrigator and at a second end to a fixed point outside the irrigator such that as the cable is wound in the irrigator is moved over the terrain to be irrigated, wherein the winding means for winding in the cable comprises a winding apparatus including a drive shaft upon which a capstan drum including at least one self-tailing sheave and at least one active sheave is fixedly mounted and an idler shaft on which at least one idler sheave is rotatably mounted.

14. An irrigator as claimed in claim 13 wherein the drive shaft is in combination with a cable guide fixedly mounted to a rotating guide shaft positioned substantially centrally with respect to a cable container so that as the cable leaves the self-tailing sheave of the winding apparatus it passes through the cable guide and as the guide shaft rotates the cable is laid into the cable container.

* * * * *